United States Patent [19]

Bambacigno et al.

[11] Patent Number: 5,064,155

[45] Date of Patent: Nov. 12, 1991

[54] TANK STABILIZER

[75] Inventors: Ralph Bambacigno, Modesto; Thomas R. Lindquist, Denair, both of Calif.

[73] Assignee: Convault, Inc., Denair, Calif.

[21] Appl. No.: 486,326

[22] Filed: Feb. 28, 1990

[51] Int. Cl.[5] ..... A47G 23/02

[52] U.S. Cl. ..... 248/146; 52/167 R

[58] Field of Search ..... 248/146, 149, 150, 154, 248/585, 346, 152; 220/18, 71, 1.5, 1 B; 52/167 R, 294

[56] References Cited

U.S. PATENT DOCUMENTS

| | | | |
|---|---|---|---|
| 1,634,084 | 6/1927 | Ruths | 248/146 |
| 2,463,880 | 3/1949 | Jones | 248/146 |
| 2,952,380 | 9/1960 | Hampton | 248/146 |
| 4,065,022 | 12/1977 | Cainavd | 220/71 |
| 4,315,385 | 2/1982 | Moreau | 52/267 X |
| 4,441,678 | 4/1984 | Dorpmund | 220/1.5 |
| 4,496,130 | 1/1985 | Toyama | 52/167 |
| 4,514,941 | 5/1985 | Gonzalez | 52/167 |
| 4,826,644 | 5/1989 | Lindquist et al. . | |
| 4,883,250 | 11/1989 | Yano | 52/167 X |
| 4,931,235 | 6/1990 | Lindquist et al. . | |
| 4,934,122 | 6/1990 | Lindquist . | |

FOREIGN PATENT DOCUMENTS

| | | | |
|---|---|---|---|
| 1477888 | 5/1989 | U.S.S.R. | 52/167 |
| 936423 | 9/1963 | United Kingdom | 52/167 |

*Primary Examiner*—J. Franklin Foss

*Attorney, Agent, or Firm*—Townsend and Townsend

[57] ABSTRACT

A tank stabilizer (6, 50) for an above ground liquid storage tank (8) of the type having one or more bottom supports or skids (10) to support the tank a distance above a support surface (16). The tank stabilizer includes lateral supports (20,56), preferably trough-like or U-shaped structures, which are secured to the support surface and configured so the bottom supports fits snugly therein. The tank stabilizer restricts horizontal movement of the tank relative to the support surface during an earthquake. The tank stabilizer may include an upwardly extending liquid barrier (34) circumscribing the lateral supports to help contain any spills or leaks.

16 Claims, 2 Drawing Sheets

TANK STABILIZER

BACKGROUND OF THE INVENTION

The invention relates to a tank stabilizer for an above ground liquid storage tank.

Earthquakes are a phenomenon during which the Earth's crust is set shaking for a period of time. The shaking is caused by the passage through the Earth of seismic waves or low frequency sound waves that are emanated from a point in the Earth's interior where a sudden rapid motion has taken place. This shaking of the Earth's crust has been known to cause the lateral movement of heavy structures including above ground liquid storage tanks.

The safe containment of liquids, particularly gasoline and other fuels, is of growing importance because of the vast amount of fuel presently stored throughout the country. There is clear evidence that underground storage tanks can and do leak, causing serious short-term and long-term problems. Thus, greater consideration is being given to the use of above ground liquid storage tanks for safe containment.

Even though above ground liquid storage tanks can be constructed by a method that results in an extremely stable tank structure that is resistent to earthquakes and other cataclysmic events, an above ground tank, without lateral support to restrain it, can still shift or slide in a horizontal direction during such events.

Shifting or sliding of an above ground liquid storage tank can result in external pipes and lines being ruptured and, in extreme cases, the tank colliding with another tank or structure. This in turn can result in a release of a flammable liquid, which can ignite into a fire that poses an even greater hazard to safety. In addition, such tanks are often used to store toxic materials, which can pose a hazard to air, water and food supplies when released in an uncontrolled manner. Unrestrained liquid storage tanks located near major earthquake faults may present a hazard to the health and safety of individuals and the community in the area.

SUMMARY OF THE INVENTION

The present invention is directed to a tank stabilizer for an above ground liquid storage tank of the type having one or more bottom supports, which support the tank on a support surface, preferably a reinforced concrete pad. The bottom supports, typically skids, have a bottom surface and a circumferential sidewall. The tank stabilizer includes a lateral support having an upwardly extending portion configured to lie adjacent the circumferential sidewall of the bottom support. The lateral support may be configured to lie opposite the entire length of the circumferential sidewall of the bottom support. The lateral support is secured to the support surface to restrict horizontal movement of the tank in at least one direction. The invention thus increases the stability of an above ground liquid storage tank during earthquakes or other cataclysmic events by resisting horizontal motion of the tank during such events. Restricting such horizontal movement can help prevent damage to any of the tank's connecting pipes, prevent damage to the tank and prevent damage to nearby objects and structures.

The tank stabilizer preferably is made so that the skids rest directly on the support surface. This is especially advantageous when the skids and support surface are both of concrete due to the friction developed between the two.

The tank stabilizer may include a frame, secured to the support surface, including an upwardly extending liquid barrier circumscribing the lateral support. The liquid barrier acts as a drip pan to collect leaks from the tank.

Other features and advantages of the invention will appear from the following description in which the preferred embodiment are set forth in detail in conjunction with the accompanying drawings.

DETAILED DESCRIPTION OF THE PREFERRED EMBODIMENTS

Figure 1:
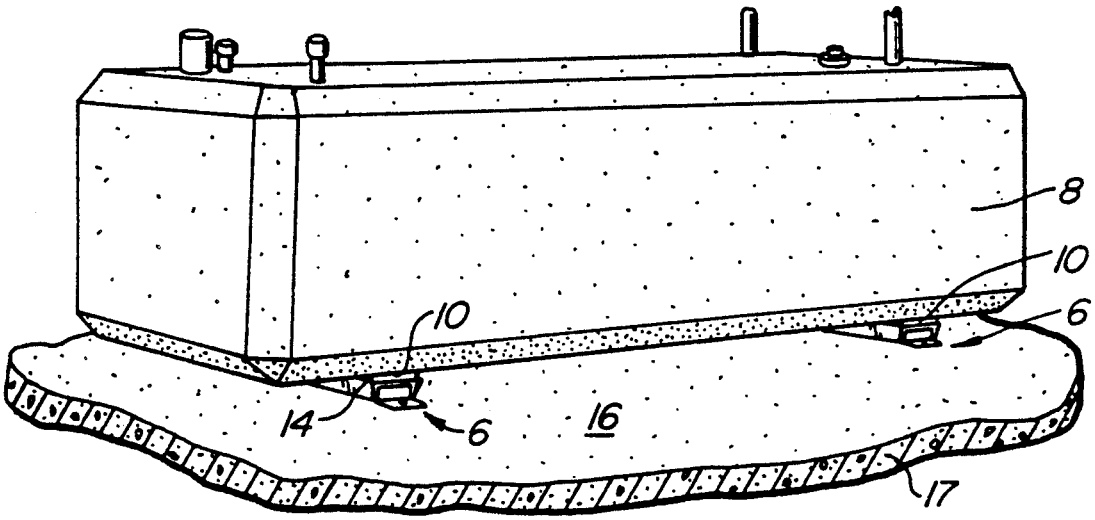
FIG. 1 is an isometric drawing of an above ground liquid storage tank and a tank stabilizer for the tank.
Figure 2:
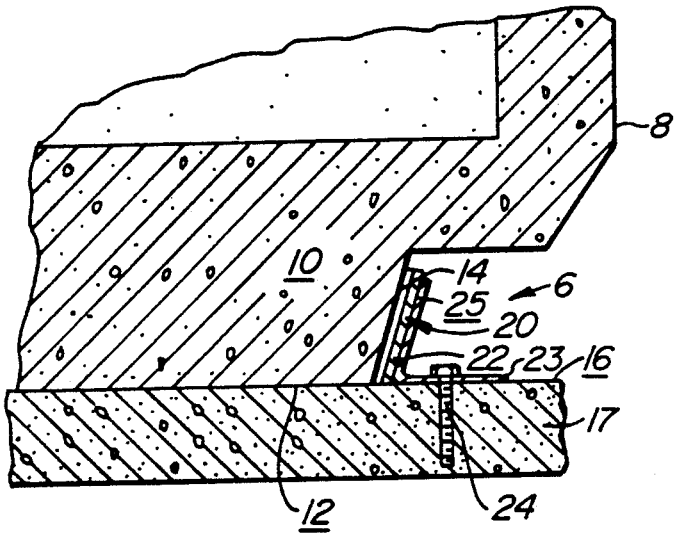
FIG. 2 is a partial cross-sectional view of one of the tank of FIG. 1 shown mounted to a reinforced concrete slab with the bottom support of the tank engaged within the tank stabilizer.

Referring to FIGS. 1 and 2, a pair of tank stabilizers 6 are shown with an above ground liquid storage tank 8 of the type having a pair of skids or bottom supports 10. Each bottom support 10 has a bottom surface 12 and a circumferential sidewall 14. Tank 8 rests on a support surface 16 through its bottom supports 10. Support surface 16 is the upper surface of a reinforced concrete slab 17. In the preferred embodiment surfaces 12, 16 are both concrete surfaces so that the sliding friction between them can be substantial.

Tank stabilizer 6 includes trough-like lateral supports 20. Lateral supports 20 are sized to snugly accept the bottom supports 10 of tank 8. Each lateral support 20 has upwardly extending sidewalls 22 positioned opposite circumferential sidewall 14. Tank stabilizer 6 further includes L-brackets 23 secured to the outer surface 25 at each end of sidewall 22. Each L-bracket 23 has a base through which a bolt 24 passes to secure lateral supports 20 to support surface 16. Lateral supports 20 resist the horizontal movement of tank 8 should an earthquake occur. Slab 17 may include posts driven into the ground or other structure to help keep slab 17 from shifting or moving relative to the ground.

Sidewalls 22 are preferably tapered for ease of placement of bottom supports 10 of tank 8 within the interior of lateral supports 20. Instead of bolts 24 and L-brackets 23, other fasteners may be used to secure lateral supports 20 to support surface 16. For example, bolts 24 may be used to secure bottom 18 directly to support surface 16.

Figure 3:
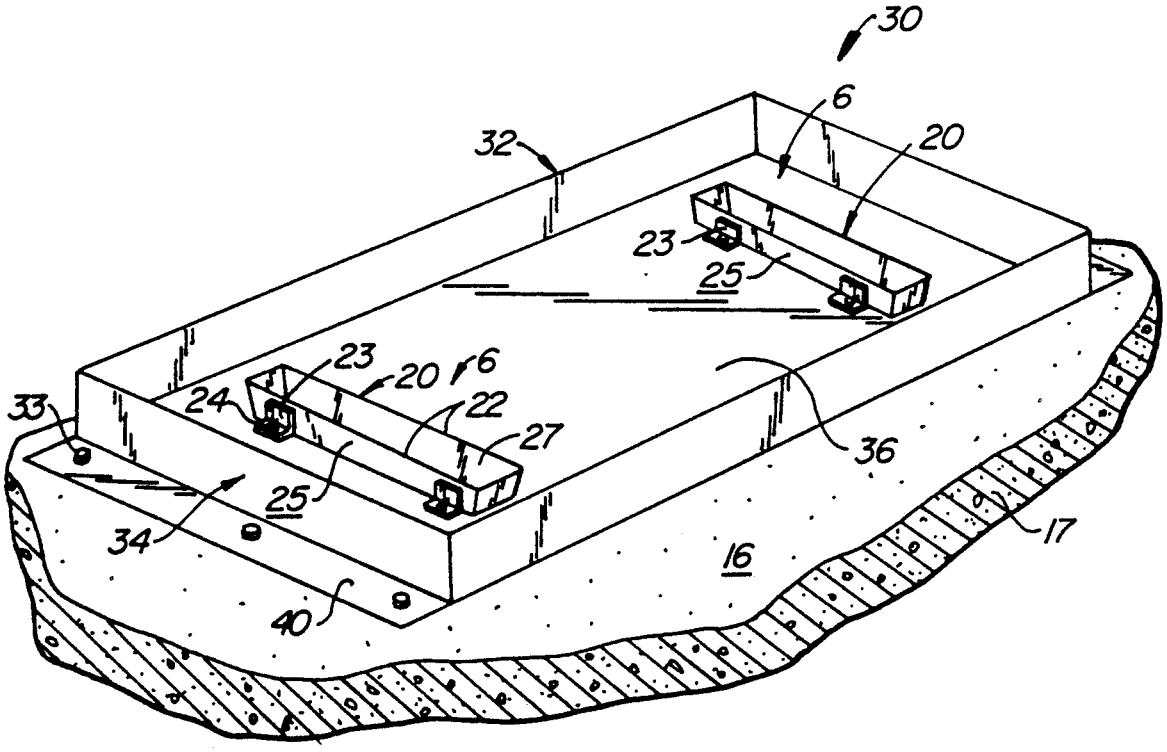
FIG. 3 is an isometric view of an alternative embodiment of a tank stabilizer which includes a liquid barrier or drip pan for capturing leaks or spills from the tank.

Referring to FIG. 3, a tank stabilizer assembly 0 is shown. Assembly 30 is similar to the embodiment of FIGS. 1 and 2 with like elements indicated by like reference numerals. Assembly 30 includes a frame 32 secured to support surface 16 by bolts 33 passing through flanges 40. Frame 32 includes a bottom 36 and a liquid barrier 34 circumscribing lateral supports 20 and extending upwardly from bottom 36. L-brackets 23 are used along the sides, rather than at the ends, of lateral supports 20. Liquid barrier 34 permits the collection of any leaked liquid to prevent damage from escape of liquids. Tank stabilizers 6 are secured to both bottom 36 and support surface 16 by bolts 24 through L-brackets 23. Tank stabilizers 6 may also be welded to bottom 36 of frame 32.

Various other methods for securing frame 32 to support surface 16 may also be used. For example, frame 34 could be made as an integral part of slab 17.

Figure 4:
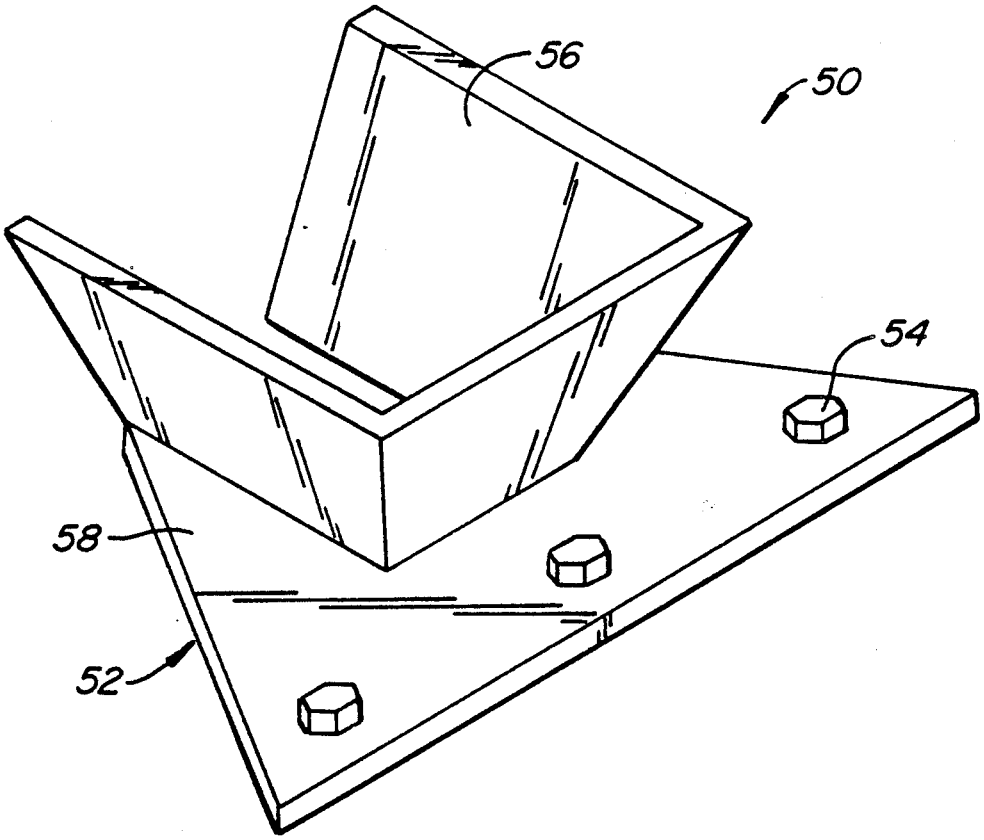
FIG. 4 is an isometric view of a further embodiment of a tank stabilizer.

FIG. 4 illustrates a further tank stabilizer 50 similar to stabilizer 6 but especially suited for stabilizing tanks 8 already in place. Stabilizer 50 includes a generally U-shaped shoe 52 and bolts 54. Shoe 52 includes a sidewall 56, shaped to generally conform to the ends of bottom supports 10, and a base flange 58, having openings through which bolts 54 pass. Shoes 52 are placed around the ends of bottom supports 10 and bolted into place. For tank 8, four stabilizers 50 are used, two for each bottom support 10.

Other modifications and variations can be made of the preferred embodiments without departing from the subject of the invention as defined by the following claims. For example, sidewalls 22 need not be solid sheets of material. Stabilizers 6 could, for example, be made using a number of L-shaped flanges shaped and positioned for receipt of bottom supports 10. Surface 16, properly sealed, could constitute bottom 36 of assembly 30. Slab 17 could also be formed with an integral lip so that by sealing the upper surface 16 of the slab, the slab could act as a liquid barrier to catch and hold any leaks.

What is claimed is:

1. A tank stabilizer for an above ground storage tank of the type having a bottom support, the bottom support having a bottom surface and a circumferential side wall, the bottom support resting on a support surface, the stabilizer comprising:

a lateral support having an upwardly extending portion configured to lie adjacent the circumferential side wall; and means for securing the lateral support to the support surface to restrict horizontal movement of the tank in at least one direction, said lateral support securing means including a flange secured to the lateral support, said flange configured to lie adjacent the support surface.

2. A tank stabilizer as recited in claim 1, wherein said lateral support includes four sidewalls.

3. A tank stabilizer as recited in claim 1, wherein said lateral support has four sidewalls.

4. A tank stabilizer as recited in claim 1, wherein said lateral support encircles the circumferential sidewall of the bottom support of the tank.

5. A tank stabilizer as recited in claim 1, wherein said lateral support securing means includes a bolt, which engages said flange and said support surface.

6. A tank stabilizer as recited in claim 1, wherein said lateral support has an open bottom and the bottom surface of the bottom support rests directly on the support surface.

7. A tank stabilizer as recited in claim 1, further comprising:

a frame, secured to the support surface, including an upwardly extending liquid barrier circumscribing the lateral support.

8. A tank stabilizer as recited in claim 7, wherein said frame has a bottom.

9. A tank stabilizer as recited in claim 8, wherein said lateral support securing means includes a securing element attached to the liquid barrier.

10. A tank stabilizer as recited in claim 9, wherein said securing element includes a flange configured to lie adjacent the support surface.

11. A tank stabilizer as recited in claim 10, wherein said liquid barrier has an outside surface and said flange is welded to said outside surface.

12. A tank stabilizer as recited in claim 11, wherein said securing element includes a bolt which engages the flange.

13. A tank stabilizer as recited in claim 12, wherein said liquid barrier includes four sidewalls.

14. A tank stabilizer for an above ground storage tank of the type having a bottom support, the bottom support having a bottom surface and a circumferential side wall, the bottom support of the tank resting on a support surface, the stabilizer comprising:

a lateral support having an upwardly and outwardly extending portion configured to lie adjacent the circumferential side wall;

means for securing the lateral support to the support surface to restrict horizontal movement of the tank in at least one direction, said lateral support securing means including a flange configured to lie adjacent the support surface; and a frame, secured to the support surface, including a bottom and an upwardly extending liquid barrier circumscribing the lateral support.

15. A tank stabilizer for an above ground storage tank of the type having elongate downwardly extending bottom support skids, the bottom skids each having a bottom surface, a circumferential sidewall and ends, the tank resting on a support surface, the stabilizer comprising:

at least one elongate trough shaped lateral support shaped to engage the ends of the bottom support skids, said trough including:

two side plates, each side plate extending upwardly from said base plate and outwardly away from one another; and an end plate secured to the side plates, whereby the side plates and the end plate define a downwardly and inwardly tapering opening sized to generally conform to the shape of the skids at the ends thereof; and means for securing said trough to the support surface.

16. A tank stabilizer for an above ground storage tank of the type having elongate skids which support the tank above a support surface, the skids having side walls and ends, comprising:

generally U-shaped shoes sized to engage the side walls of the skids at the ends of the skids, said shoes including generally upwardly and outwardly extending walls and a flange configured to lie adjacent the support surface; and means for securing the shoes to the support surface.

* * * * *